United States Patent [19]

Harris

[11] Patent Number: 5,038,421

[45] Date of Patent: Aug. 13, 1991

[54] SOFABED

[76] Inventor: Anne M. Harris, 40 W. 72nd St., New York, N.Y. 10023

[21] Appl. No.: 527,060

[22] Filed: May 22, 1990

Related U.S. Application Data

[63] Continuation-in-part of Ser. No. 321,502, Mar. 9, 1989, Pat. No. 4,953,242.

[51] Int. Cl.[5] ..... A47C 17/13

[52] U.S. Cl. ..... 5/18.1; 5/12.1

[58] Field of Search ..... 5/18.1, 12.1, 465, 28, 5/17; 297/111, 118

[56] References Cited

U.S. PATENT DOCUMENTS

| | | | |
|---|---|---|---|
| 3,751,739 | 8/1973 | Assmann | 5/12.1 |
| 3,902,759 | 9/1975 | Monthforte et al. | 5/12.1 |
| 4,473,254 | 9/1984 | Secon | 5/18.1 |

FOREIGN PATENT DOCUMENTS

| | | | |
|---|---|---|---|
| 2323255 | 11/1974 | Fed. Rep. of Germany | 5/28 |
| 2223951 | 10/1974 | France | 5/12.1 |
| 2526649 | 11/1983 | France | 5/13 |
| 595273 | 12/1947 | United Kingdom | 5/18.1 |

*Primary Examiner*—Alexander Grosz

*Attorney, Agent, or Firm*—Jones, Day, Reavis & Pogue

[57] ABSTRACT

A convertible sofabed is a sofa when closed in a sitting position and a bed when opened in a sleeping position. A retractable support structure can be telescoped from the sofa to form, in conjunction with the sofa, a bed that is longer than the depth of the sofa in its sitting position. The mattress in the sleeping position is folded in three portions, a fixed portion, a central portion and an outer portion. The outer portion forms a sofaback in the sitting position and the central portion folds to lie on top of the fixed portion to form the seat of the sofabed. A pillow folds in two to support the sofaback and the seat at their junction when the sofabed is closed in the sitting position, and unfolds to serve as a pillow for the bed when the sofabed is opened into the sleeping position.

7 Claims, 7 Drawing Sheets

126
142
122
168
164
144
130
128
148
146
152
154
156
153
136
132
134
140
120
172
176

SOFABED

CROSS-REFERENCES TO RELATED APPLICATIONS

This application is a continuation in part of my application Ser. No. 321,502, filed Mar. 9, 1989, now U.S. Pat. No. 4,953,242.

BACKGROUND OF THE INVENTION

This invention is an improved sofabed that is convertible between a sitting unit and a sleeping unit.

The mechanisms used in making convertible furniture that is intended to be converted between a sitting unit or seat in the closed position and a sleeping unit or bed in the open position are usually complicated devices. These devices include springs, bars, and hinges which may damage sheeting or upholstery. Furthermore, these devices increase the weight of the furniture, making it more difficult both to move the furniture and to convert it. Conventional conversion procedures have been relatively difficult and complicated, especially for the elderly, children and the handicapped. In addition, the devices often require substantial volume, adding to the volume occupied by the furniture. This is usually apparent in an increase in the depth of the furniture, which is undesirable since space is often at a premium. A buyer of convertible furniture often intends to reduce the floor space required by using a single piece of furniture to function alternatively as either of two pieces. Prior designs for sofabeds require about four inches between the mattress and the back of the sofabed in order for the conversion mechanism to operate. As a result, a standard sofabed has a length of eighty-nine inches, which is longer than the length of a standard bed.

Accessory tables are often required to support lighting in the immediate vicinity of the furniture. Additionally, the usual accouterments of a bed, including the blankets, sheets, and pillows, are often not easily and safely stored within the furniture in its closed position.

SUMMARY OF THE INVENTION

In contrast to existing convertible furniture, a unit that is convertible between sitting and sleeping furniture can be constructed so that the conversion process is relatively simple and the unit is more compact. A slidable support structure is easily retracted from a main housing to enlarge the sitting surface of a sofa sufficiently to allow its use as a bed. A mattress for this bed is provided by unfolding the triple mattress that forms the back of the sofa with one fold and doubles to form two folds that comprise the seat of the sofa. A pillow is folded to provide support at the intersection of the top section and the other two sections of the mattress in the closed or sitting configuration. When the sofabed is opened, the pillow is unfolded to function as a pillow for the bed.

BRIEF DESCRIPTION OF THE DRAWINGS

FIG. a perspective view of a sofabed closed in a sitting position.

DETAILED DESCRIPTION OF THE INVENTION

Figure 1:
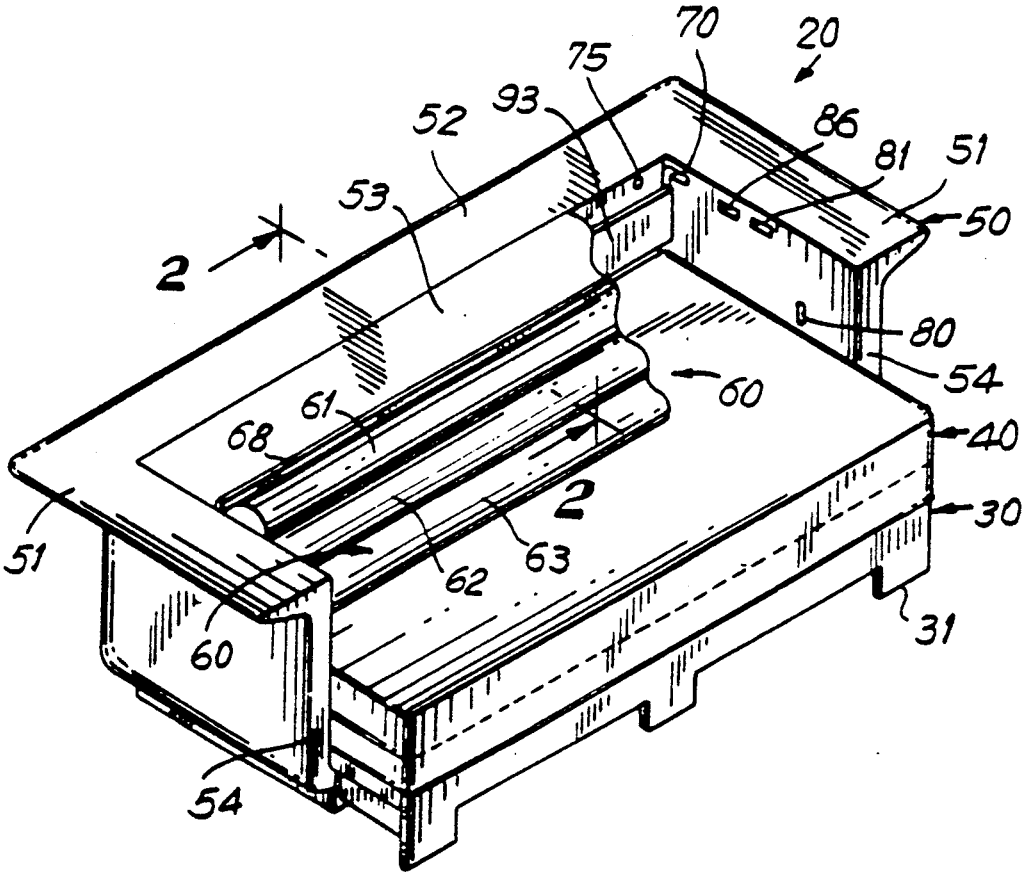

FIG. 1 shows a convertible sofabed in a closed sitting position 20 comprising a retractable bottom member 30, a double mattress 40 which cushions the seating area, a top housing 50 which partially encloses the bottom member 30, and a back cushion member 60. Bottom member 30 comprises a facing 31 and a first bedspring 32 that is supported by two or more solid legs 33. Facing 31, which is attached to legs 33, serves to protect internal mechanisms of the furniture from dirt and damage, to prevent damage to clothing, etc., from the bedspring 32, and as a means to partially withdraw bottom member 30 from top housing 50. Also, facing 31 is esthetically pleasing in color and texture, and carries out the design of the furniture. First bedspring 32 and second bedspring 56 comprise steel bands or beechwood slats.

While the drawings show furniture convertible between a sofa and a full-sized bed, the size of the furniture may, of course, be larger or smaller in order to fit more conveniently within any desired space. That is, a combination chair and single bed or a love seat and three-quarter bed might require only two legs while a combination sofa and full bed, sofa and queen, or sofa and king bed might require three legs. The number of legs 33 is determined by the length of the unit.

Figure 2:
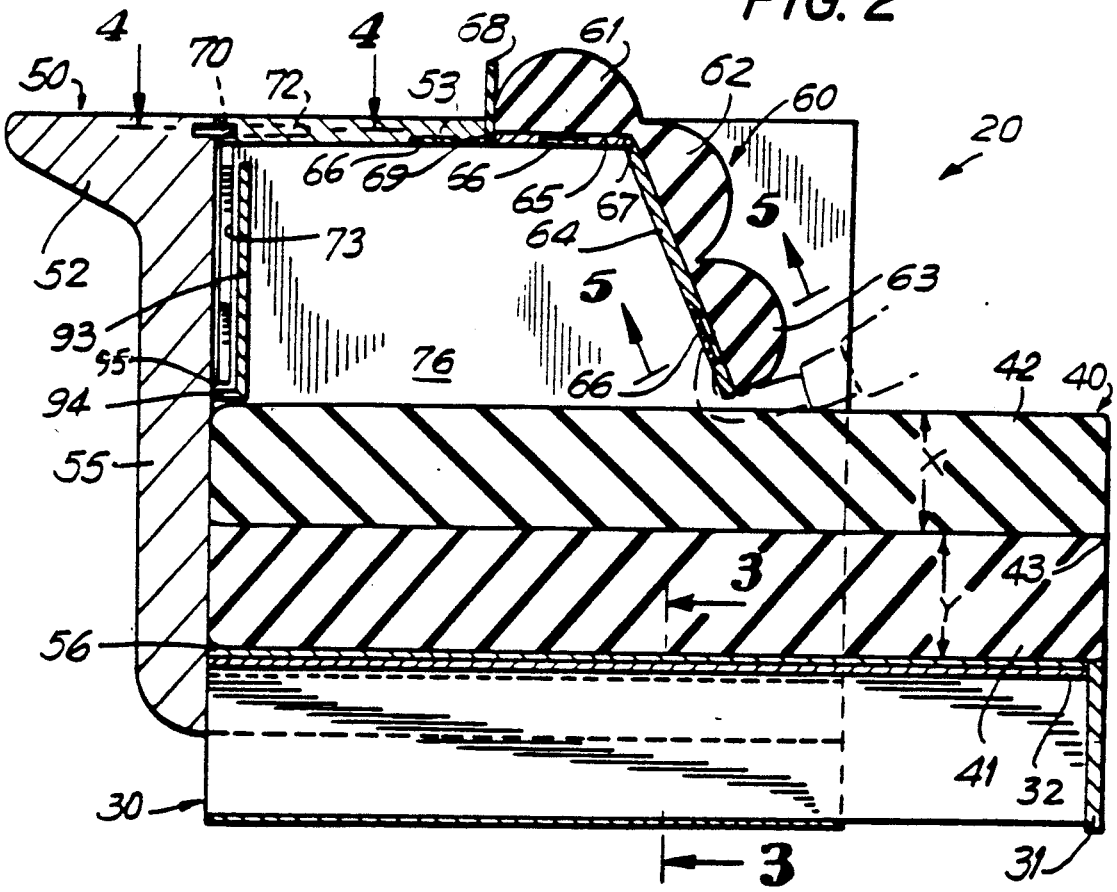
FIG. 2 is a view taken along section lines 2—2 of FIG. 1 showing a side cross-section of the sofabed in the closed or sitting position.

As shown in FIG. 2, bottom member 30 is inserted so as to slide within top housing 50 when the furniture is in the sitting position 20. Double mattress 40 consists of a lower mattress 41 and an upper mattress 42. When the furniture is in the sitting position 20, a user of the furniture would sit upon upper mattress 41 and could lean against back cushion member 60. Upper and lower mattresses 41 and 42 may be connected by material 43 so that when the mattresses 41 and 42 are unfolded or opened to create a flat surface 91 of the convertible sofabed in the sleeping position 90, the mattresses 41 and 42 remain in close proximity and in proper alignment. The thickness X of upper mattress 42 should be slightly greater than the thickness Y of lower mattress 41 in order to compensate for the slightly lower resting position of upper mattress 42 in the open position 90.

Top housing 50 comprises two horizontal side ledges or arm rests 51, a horizontal back ledge 52, a slidable top platform 53, two horizontal side walls 54, a horizontal back wall 55, a second bedspring 56, and a sleeve 57. Side ledges 51 and back ledge 52 are convenient for placing lamps, drinks, books, decorations, etc. These ledges 51 and 52 obviate the need for the usual accessory tables, saving both the cost of those tables and the floor space otherwise required for them. While ledges 51 and 52 may be upholstered, they should not be heavily cushioned but rather must remain relatively level so as to readily support any objects placed upon them. Further, top platform 53 is substantially contiguous with the ledges 51 and 52 and forms an extended flat surface. Additionally, the chamber (not shown) formed beneath ledges 51 and 52 may be used for additional storage by constructing book shelves or cabinets beneath any of ledges 51 and 52. In the alternative, chairs may be placed and utilized beneath the "table" created by the ledges 51 and 52.

As shown in FIG. 2, back cushion member 60 comprises three bubble cushions 61, 62 and 63, affixed to frames 64 and 65, which contain a plurality of slidable support bars 66. Frames 64 and 65 are preferably made of a honeycomb material which renders them both light in weight for easy handling and strong enough to support any force exerted by a person using the unit. Frames 64 and 65 are attached to each other by a hinge 67. Frame 65 is attached to flexible tab 68 that extends the length of frame 65, allowing tab 68 to be manipulated at any point and preventing small items from falling from the top platform 53. Tab 68 is useful for adjusting back cushion member 60 to allow conversion from the sitting position 20 to the sleeping position 90. Frame 65 is attached by a hinge 69 to top platform 53. When the furniture is closed in sitting position 20, back cushion member 60 encloses a storage compartment 76 useful for storing articles such as sheeting, pillows, blankets, etc., used to make up the bed when the furniture is opened in the sleeping position 90. The bubble cushion 61 is padded to prevent injury to or discomfort for the head of a person seated upon the sofa 20, while bubble cushions 62 and 63 are also padded for comfort. The bubble cushion 61 may be removed from frame 65 to extend the surface formed by top platform 53 in the closed position 20. While seams of the bubble cushions 61, 62 and 63 are illustrated as horizontal, seams may of course run vertically upon frames 64 and 65; the appearance of the furniture padding should carry out the design of the furniture and is a matter of design choice.

Figure 3:
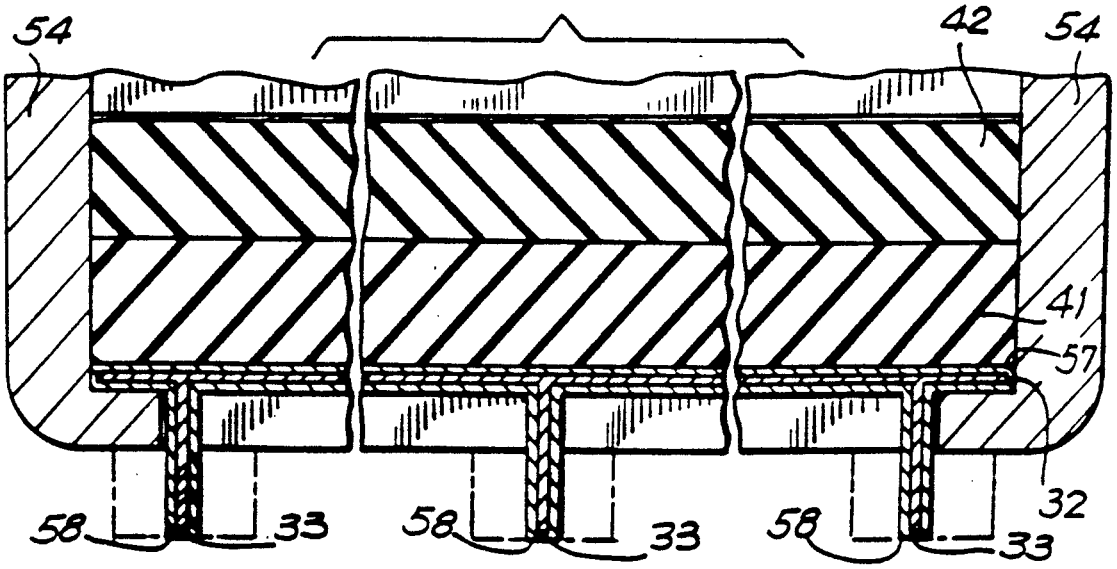
FIG. 3 is a view taken along section lines 3—3 of FIG. 2 showing a front cross-section of the lower portion of the sofabed.

FIG. 3 illustrates bottom member 30 and double mattress 40 inserted into housing member 50 in the closed sitting position 20. Legs 33 are inserted into and rest on sleeve 57 of top housing 50. Thin plates 58, preferably made of metal, form the bottom side of sleeve 57 adjacent to and resting upon the floor (not shown). Plate 58 facilitates sliding of bottom member 50 and is useful to protect the floor when converting from the sitting position 20 to the sleeping position 90. The bottom (not shown) of legs 33 can be made slidable through the use of items such as nylon glides, bearings, or a belt drive. A stopping means (not shown) prevents bottom member 30 from completely disengaging from sleeve 57. Plate 58 should be thin enough to prevent any substantial height differential of bottom member 30 from the floor when in either the sleeping position 90 or the sitting position 20. Sleeve 57 is useful to align legs 33 and to support portions of the unit, as well as objects or people resting on the unit. This feature of the present invention eliminates the bending of hinges and springs, thereby eliminating the possibility of damage to sheeting, etc. as well as decreasing the weight of the furniture which makes it easier to move and to convert. The length of a king-size sofa of the present invention is shorter than that of a conventional sofabed.

Figure 4:
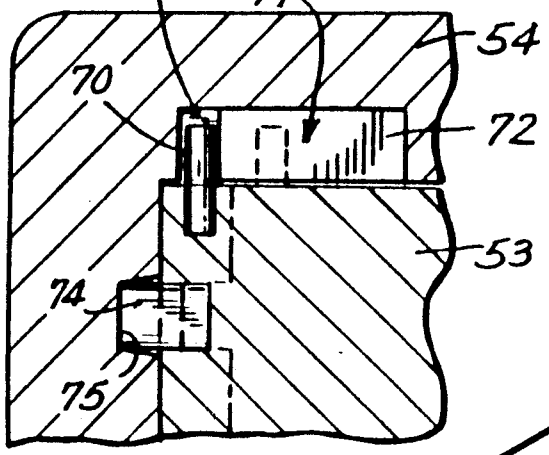
FIG. 4 is a view taken along section lines 4—4 of FIG. 2 showing the mechanisms of the top platform.

FIG. 4 illustrates a portion of top platform 53. In the sitting position 20, platform 53 is partially supported in a horizontal position by two pins 70. Each groove 71 in side walls 54 consists of a horizontal groove 72 joined to form a continuous channel with vertical groove 73. Pins 70 comprise a means of securing the top of the apparatus in the sitting position 20 and for converting the apparatus from the sitting position 20 to the sleeping position 90, while keeping top platform 53 mounted inside top housing 50. A plurality of rigid tabs 74 are mounted to the leading edge of platform 53. In the sitting position 20, tabs 74 are inserted into corresponding slots 75, which are located in horizontal back ledge 52. Tabs 74 serve as a means to support, align, and maintain top platform 53 in the sitting position 20, and the number of tabs 74 is determined by the length of back ledge 52.

Figure 5:
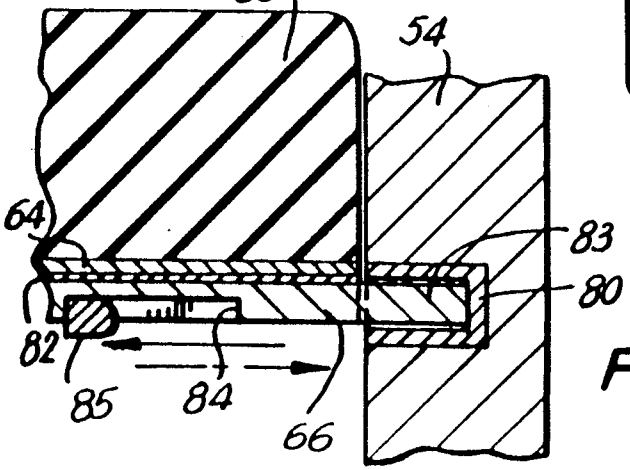
FIG. 5 is a view taken along lines 5—5 of FIG. 2 showing a support bar.

FIG. 5 shows a support bar 66 contained within frame 64. Support bar 66 is inserted into bar grooves 80 of side walls 54 in the sitting position 20. Similarly, support bar 66 that is mounted in frame 65 is insertable into bar grooves 81, and a bar support 66 mounted within top platform 53 is insertable into bar grooves 86. In the sitting position 20, support bars 66 support, align, and maintain back cushion member 60 and top platform 53 which enclose storage compartment 76. Support bar 66 comprises a bar casing 82 within which are two sliding rods 83. Each rod 83 is inserted within bar grooves 80, 81 and 86 located in each side wall 54 when the furniture is in sitting position 20. Rods 83 contain a plurality of indentations 84 usable, as by human fingers 85, for manually sliding rod 83 into a desired position within bar grooves 80, 81 and 86. To convert from sitting position 20 to sleeping position 90, first rods 83 in frame 64 are withdrawn from bar grooves 80. This frees frame 64 to swing inward, allowing access to support bars 66 on frame 65 and top platform 53.

Figure 6:
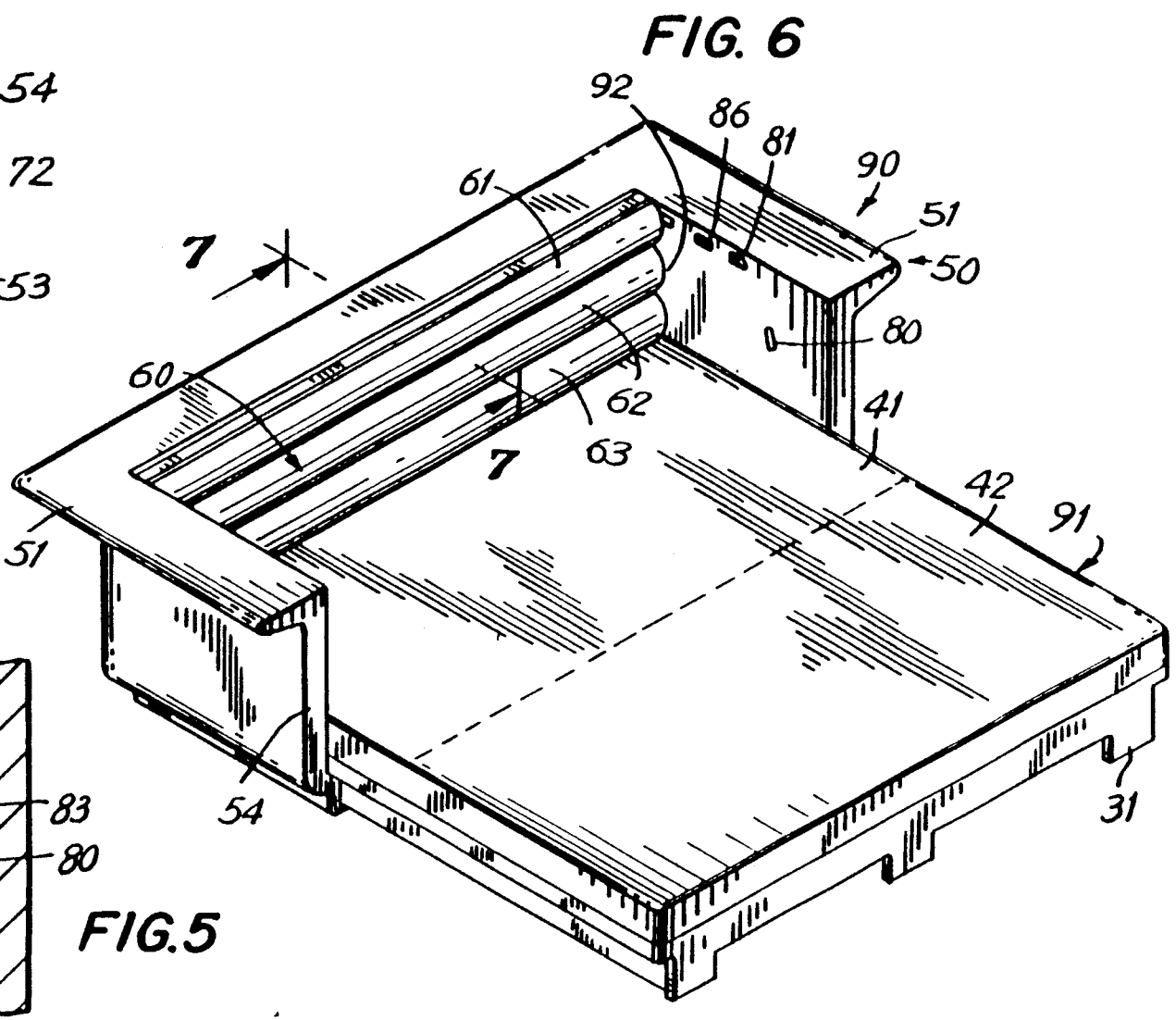
FIG. 6 is a perspective view of the sofabed open in a sleeping position.

FIG. 6 illustrates the convertible sofabed in the open sleeping position 90 in which bottom member 30 has been retracted from within top housing 50. Double mattress 40 has been unfolded to allow lower mattress 41 and upper mattress 42 to lie adjacent to each other, forming a sleeping surface 91. Top platform 53 has been inserted into chamber 95 and bubble cushions 61, 62 and 63 are aligned vertically to form head rest 92.

Figure 7:
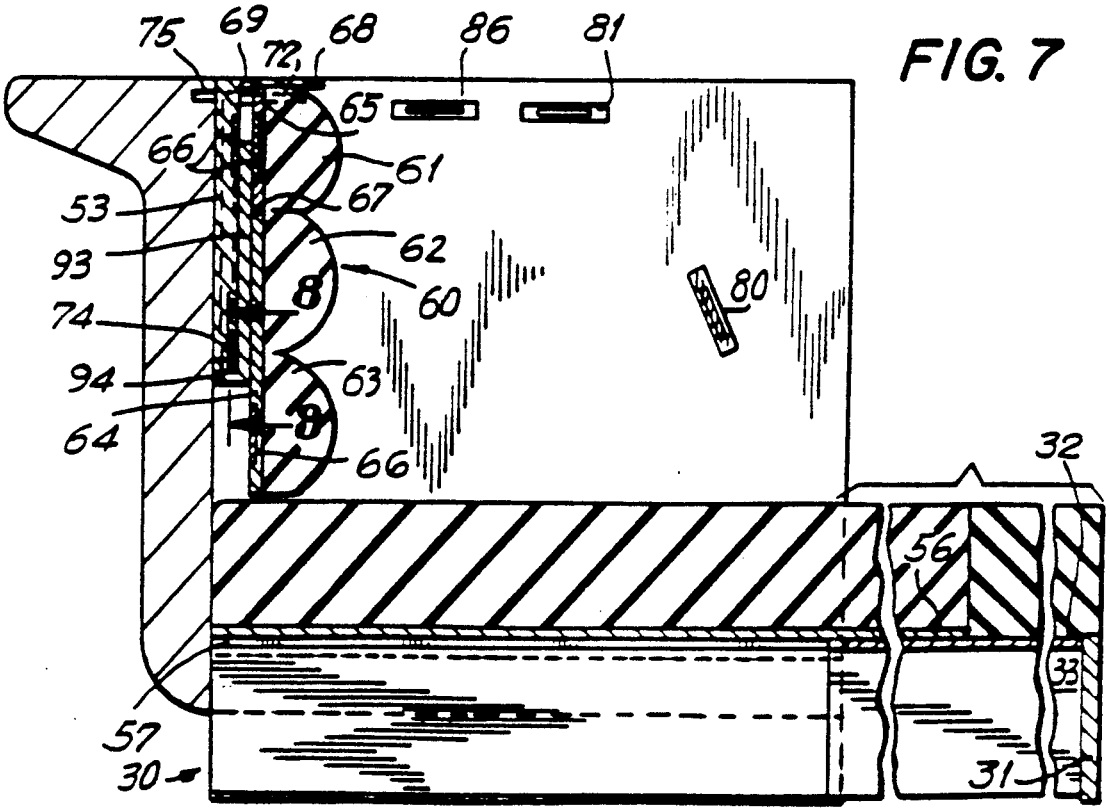
FIG. 7 is a view taken along section lines 7—7 of FIG. 6 showing a side cross-section of the sofabed in the open sleeping position.

FIG. 7 shows the back cushion member 60 converted to head rest 92 when the unit is in the open sleeping position 90. Frames 64 and 65 are aligned in a vertical position parallel to beam member 93. To convert from the sitting position 20 of FIG. 2 to the sleeping position 90 of FIG. 7, tab 68 is lifted to withdraw tabs 74 from slots 75 and to position top platform 53 (with tabs 74 leading) in a downward direction. Using tab 68, top platform 53 is inserted into chamber 95, which is formed by wall member 93 and back wall 55, with pins 70 extending from horizontal grooves 72 to vertical grooves 73 Platform 53 is supported on bottom beam member 94 of wall 93. Lifting tab 68 simultaneously allows frames 64 and 65 to align vertically against beam member 93 outside of chamber 95.

Figure 8:
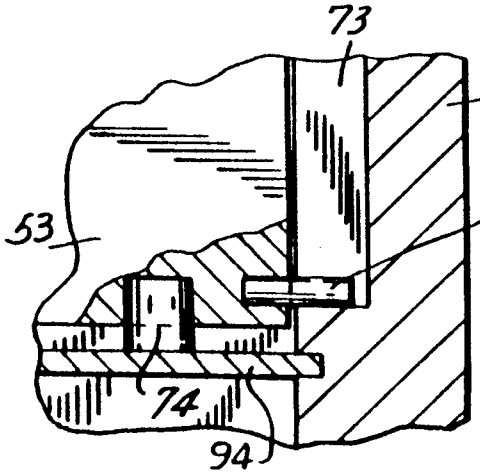
FIG. 8 is a view taken along section lines 8—8 of FIG. 7 showing securing mechanisms of the top platform.

FIG. 8 shows a portion of top platform 53 as aligned when the unit is in sleeping position 90. Pins 70, mounted on each side of the platform 53, protrude from it into the two vertical grooves 73 in side walls 54, securing platform 53 in the unit. Tabs 74 rest on bottom beam member 94.

Figure 9:
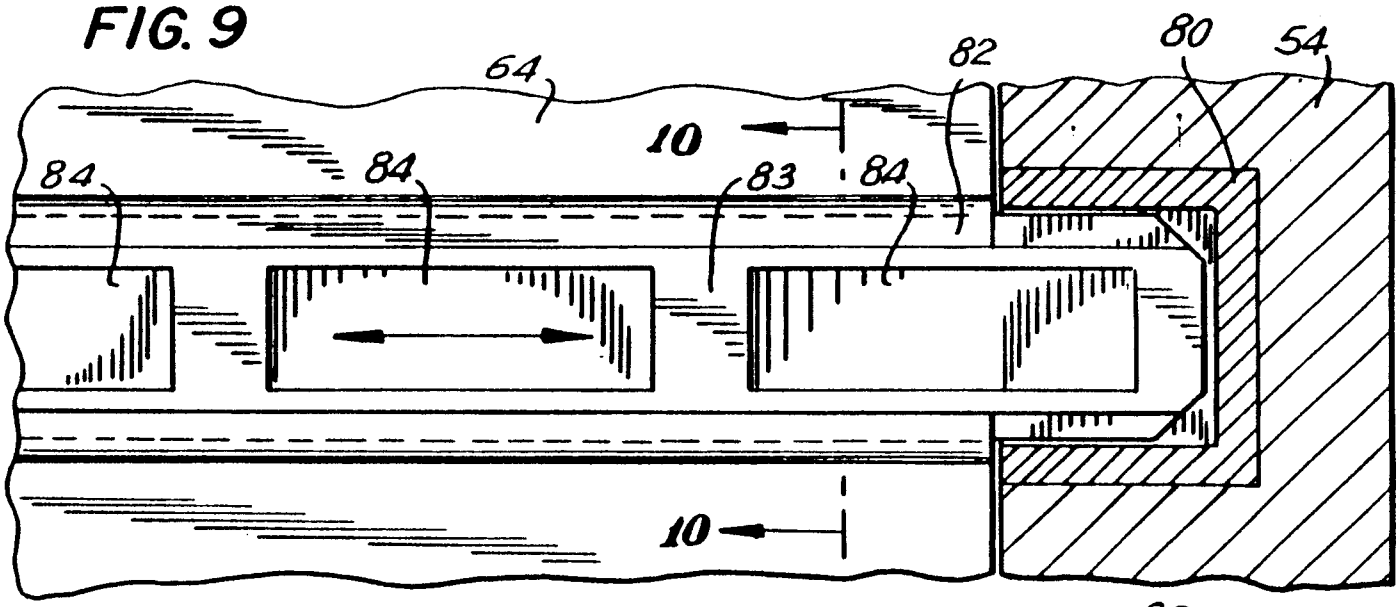
FIG. 9 is a front view of a slidable insertable support bar.

FIG. 9 illustrates a portion of the unit in sitting position 20 detailing the support bar 66 from a front view. Bar casing 82 is contained in frame 64 and rod 83 is inserted so as to slide in bar groove 80, which is in side wall 54. In sitting position 20, rod 83 is inserted and withdrawn from bar groove 80 manually by indentations 84. Similarly, rods 83 are appropriately inserted in bar grooves 81 and 86.

Figure 10:
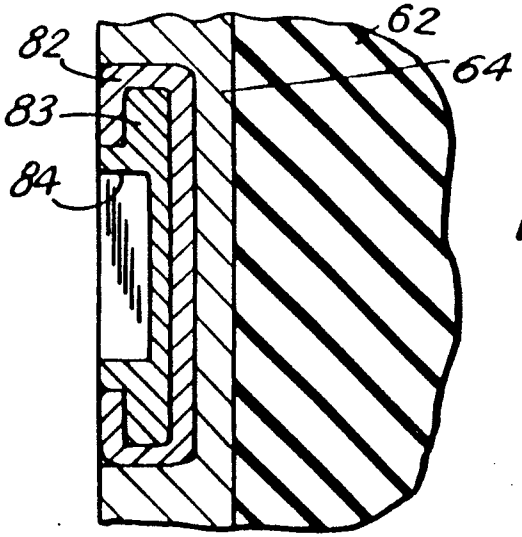
FIG. 10 is a view taken along section lines 10—10 of FIG. 9 shows a cross-section of the support bar.
Figure 11:
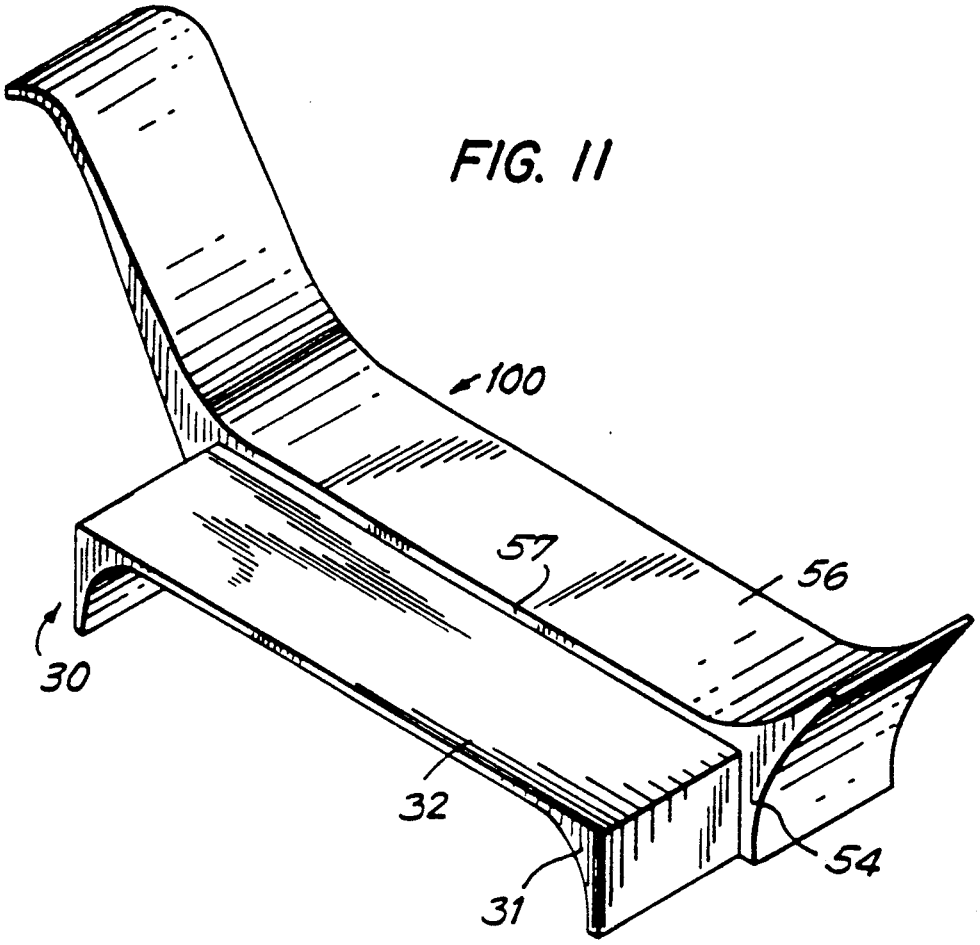
FIG. 11 is a perspective view of a sleep bench open in the sleeping position.

FIG. 10 illustrates the support bar 66 in cross section as contained in frame 64. Bar casing 82 encloses rod 83, and indentation 84 is located on rod 83. Retractable bottom member 30 can be used in other furniture from which the sitting position 20 can be converted in addition to sofas. For example, sleep bench 100, as shown in FIG. 11, can be converted between the sleep bench 100 and a twin bed in which a bottom member 30 retracts from sleeve 57. A double mattress 40 (not shown in FIG. 11) will rest upon second bedspring 56 when the furniture is in sitting position 20 and will unfold to rest upon both first bedspring 32 and second bedspring 56 in sleeping position 90. As shown, facing 31 may cover two legs 33.

Figure 12:
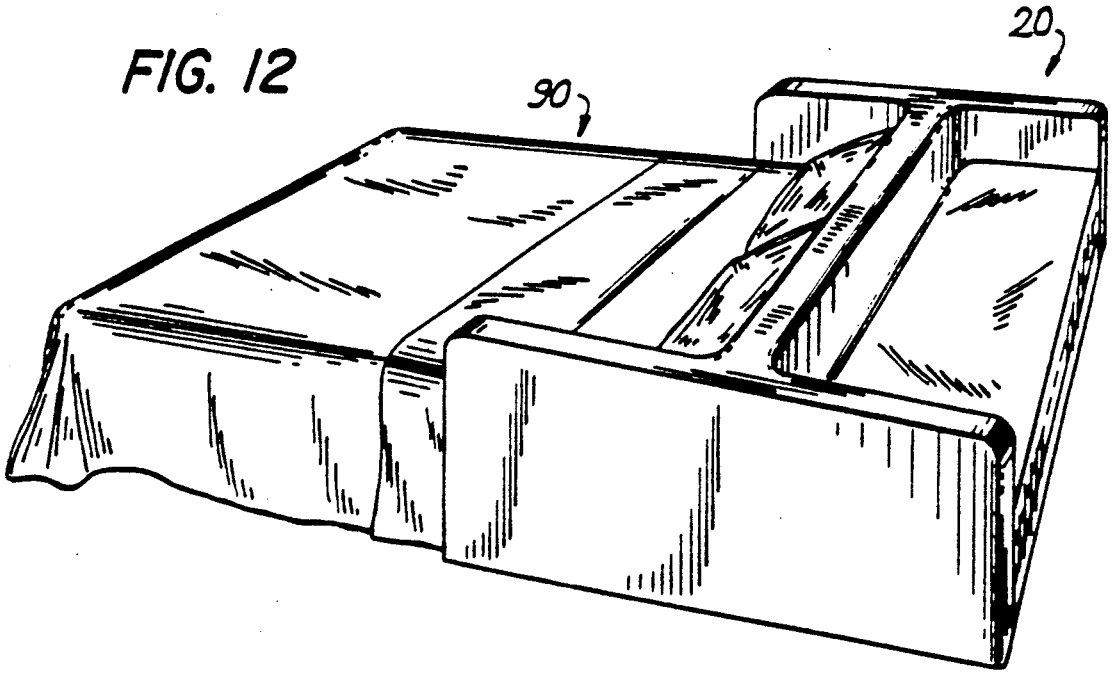
FIG. 12 is a perspective view of a combined double sofa and single bed open in the sleeping position.

FIG. 12 illustrates a combination of a double sofa and a single bed where the sofabed in the closed sitting position 20 will feature two sofas (not shown), while the sofabed in the open sleeping position 90 will feature both a bed 90 and a sofa 20. The retractable bottom member 30 can therefore be useful in many configurations.

Figure 13:
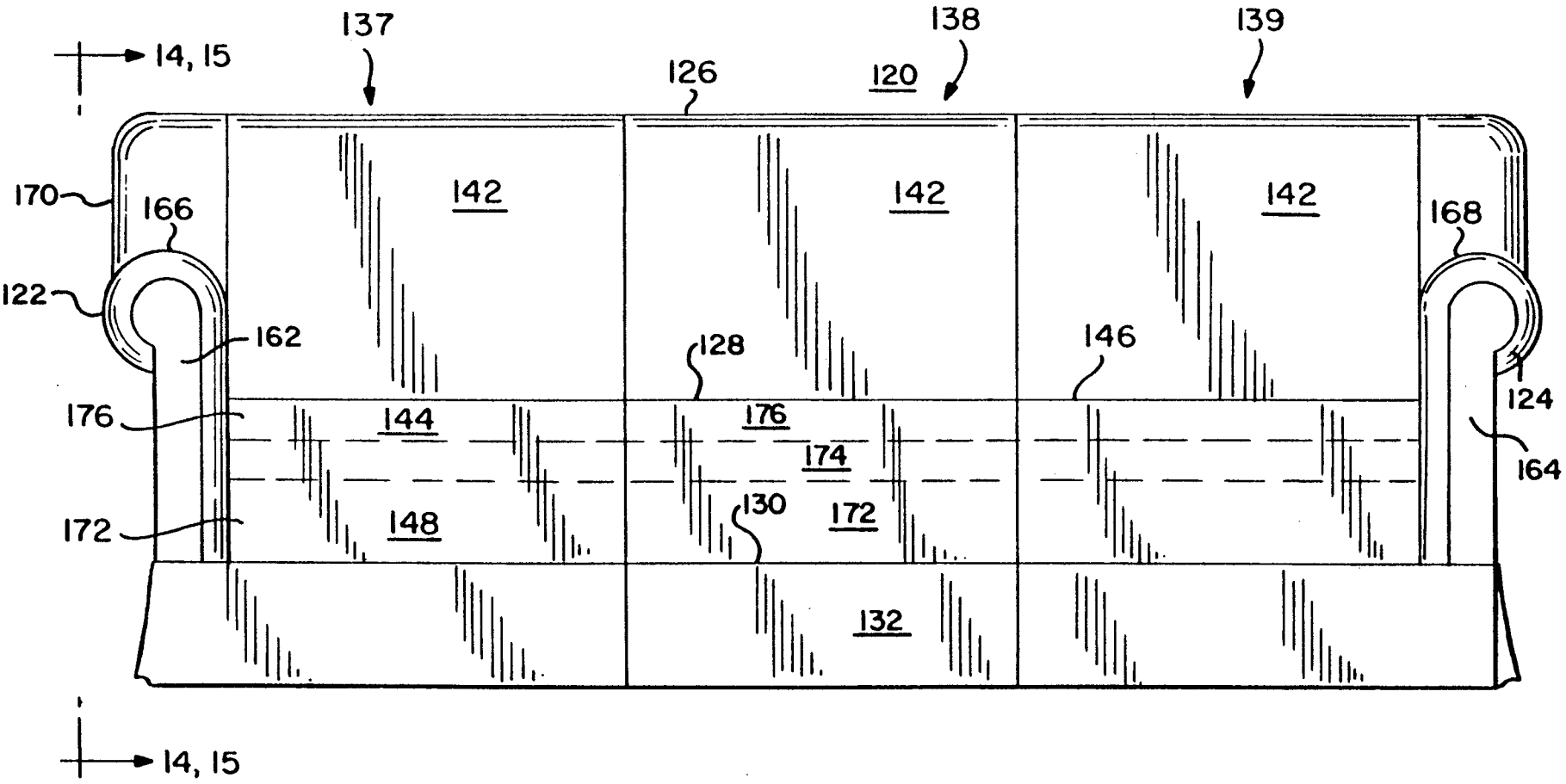
FIG. 13 is a front view of an embodiment of the sofabed of the present invention.

FIG. 13 is a front view of an embodiment of the present invention. In FIG. 13, a sofabed 120 includes a first side 122 and a second side 124. A sofaback 126 is placed between the sides 122 and 124 and is connected by a connector 146 a seat 144. The connector 146 serves as a hinge when the sofabed 120 is unfolded into an open position, and may be a single continuous piece or a number of pieces of fabric, leather or plastic that are part of the upholstery of the sofabed 120. The connect 146 may also be a hinge, preferably one that is concealed. The sofaback 126 may be held in contact with the sides 122 and 124 by friction or by snaps, magnetic holders, hook and loop type closures, pins, hooks or the like.

A front cover 132 extends to or nearly to the surface upon which the sofabed 120 rests. A handle 134, which may be a strap or loop of fabric or a solid part, may project from the sofaback 126 at hinge 146 it easier to open and close the sofabed 120 by pulling it from and returning it to a frame 136, which does not move when the sofabed 120 is opened or closed. The sofabed 120 is shown as upholstered to present three sections 137, 138 and 139. This is a matter of styling that does not affect the operation of the sofabed 120 in converting between a sofa and a bed. It should also be evident that the connector 146 could equally as well be a piano hinge or a series of hinges. Similarly, the frame 136 and sofaback 126 are shown here as substantially perpendicular to the plane of the seat 130. They could equally as well be placed at a different angle to the seat 130.

Figures 14, 15:
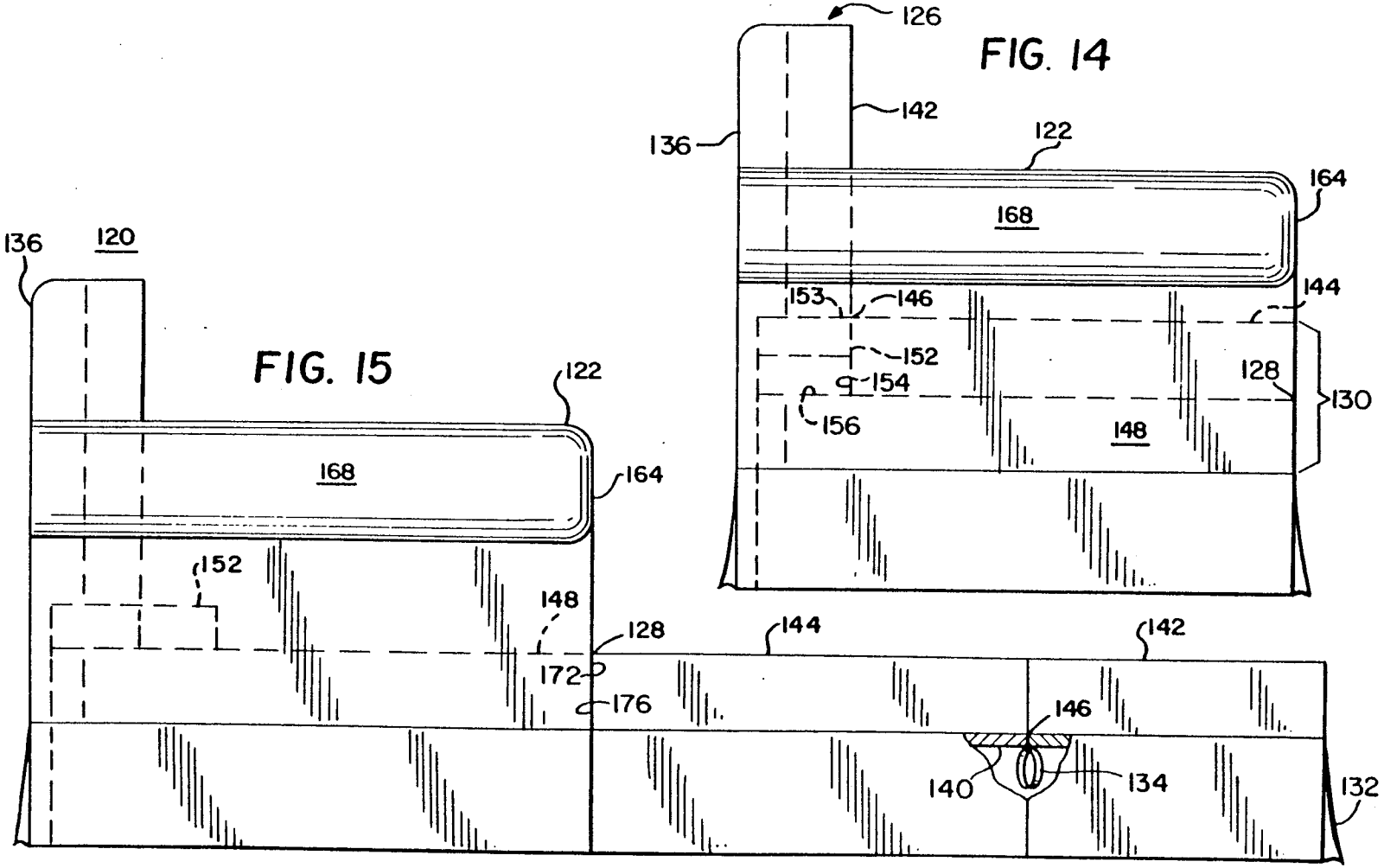
FIG. 14 is a side view of the embodiment of FIG. 13, taken along section lines 14—14 of FIG. 13 when the sofabed is in the closed position.
FIG. 15 is a side view of the embodiment of FIG. 13, taken along section lines 15—15 of FIG. 13 when the sofabed is in the open position.

FIG. 14 is a side view of the embodiment of FIG. 13, taken along section lines 14—14 of FIG. 13 when the sofabed 120 is in the closed position, and FIG. 15 is a side view of the embodiment of FIG. 13, taken along section lines 15—15 of FIG. 13 when the sofabed 120 is in the open position. In FIG. 15, the front cover 132 has been pulled out from the sofabed 120, extending a support structure 140 that is telescoped into the sofabed 120 in the closed position. This may be similar to the structure of FIGS. 1, 2, 3 and 5. The support structure of FIGS. 14 and 15 may be in two or three telescoping sections, although it is easier to optimize the size of the closed sofabed 120 with three sections. This is a matter of design choice. The sofaback 126 is placed on the support structure 140 at an outer end, so that the sofaback 126 forms an outer third 142 of the mattress of the sofabed 120 in the open position. The connector 146 connects the sofaback 126 to a central portion 144, which in turn is connected by a connector 128 to a fixed portion 148 of the mattress 142. When the sofabed 120 is in the closed position, the central portion 144 and the fixed portion 148 are folded together to form the seat 130 of FIG. 13. A pillow 152 is folded double when the sofabed 120 is in the closed position, so that the pillow 152 fills the junction 153 between the sofaback 126 and the ends 154 and 156 respectively of the central portion 144 and the fixed portion 148, providing structural support at the junction 153. When the sofabed 120 is opened, the pillow 152 is unfolded to serve as a pillow. The connectors 128 and 146 could either or both be single or multiple hinges as well as flaps, tabs or strips of fabric, leather or plastic to match the upholstery. If they are hinges, it would be preferable to select hinges that are hidden when the sofabed 120 is in the sofa position. The fixed portion 148 is in the same position when the sofabed 120 is open or closed, and is preferably attached to the sofabed 120 by snaps, magnetic holders, hook and loop type closures or hooks. The fixed portion 148 may also rest in place without attachments.

When the sofabed 120 is in the closed position in which it functions as a sofa, certain surfaces are exposed to view. These exposed surfaces can be covered with fabric, leather or plastic to carry out a desired decorative motif. The exposed surfaces include a right side 162 and a left side 164 that do not undergo any changes when the sofabed 120 is converted between a sofa and a bed. A right arm 166 and a left arm 168 are mostly exposed in the closed or sofa position. The front cover 132 is an exposed surface, as is the side 170 of the sofaback 126. An edge 172 of the fixed portion 148 of the mattress 142 is exposed, as are the edge 174 and surface 176 of the central portion 144. The connectors 128 and 146 are also exposed, and as a result function best for both support and decoration if they are continuous along the width of each of the sofaback 126, central portion 144 and fixed portion 148.

While particular embodiments of the invention have been described, it should be understood that the invention is not limited to these embodiments since many obvious modifications can be made. It is intended to include within this invention any modifications that fall within the scope of the invention as defined by the appended claims and their equivalents.

I claim:

1. A sofabed that is convertible between a sofa when closed and a bed when open, the sofabed adapted to stand on a surface such as a floor, the sofabed comprising:

(a) a first side;

(b) a second side;

(c) a frame connected to the first side and to the second side substantially at right angles so that the first side is maintained substantially parallel to the second side;

(d) a mattress formed of a fixed portion attached to the frame by separable fastener means, a central portion and a sofaback, the fixed portion adjoining the frame, the central portion connected by a first connector to the fixed portion, the sofaback connected by a second connector to the central portion, the sofaback placed in generally vertical contact with the frame when the sofabed is in the closed sofa position;

(e) a support structure connected to the frame and arranged to telescope into a closed position and to extend into an open position, the support structure horizontally supporting the central portion and the sofaback to form together with the fixed portion a mattress when the sofabed is in the open position; and (f) the sofabed further comprising a pillow that is foldable into two parts, the pillow when folded attached to the frame and located behind the second connector and beneath the generally vertically positioned sofaback to provide structural support for the sofaback, when the sofabed is in the closed position, said pillow, when the sofabed is in the open position, adapted to be unfolded and positioned on the fixed portion of the mattress, to thereby support a user of the open sofabed.

2. The sofabed of claim 1 comprising in addition a front cover that is attached to the support structure to provide a decorative surface.

3. The sofabed of claim 1 wherein the fixed portion is attached to the frame by snaps.

4. The sofabed of claim 1 wherein the first and second connectors are both made of a material that is used to upholster the sofa.

5. The sofabed of claim 1 wherein the frame is substantially perpendicular to the surface upon which the sofabed is adapted to stand.

6. The sofabed of claim 1 wherein the frame is maintained at an angle other than perpendicular to the surface upon which the sofabed is adapted to stand.

7. The sofabed of claim 1 wherein the first side and second side comprise respectively a first arm and a second arm.

* * * * *